US006460993B2

(12) United States Patent
Pilu

(10) Patent No.: US 6,460,993 B2
(45) Date of Patent: Oct. 8, 2002

(54) PRINTING ON LENTICULAR MEDIA

(75) Inventor: Maurizio Pilu, Bristol (GB)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/862,582

(22) Filed: May 23, 2001

(65) Prior Publication Data

US 2001/0048458 A1 Dec. 6, 2001

(30) Foreign Application Priority Data

May 24, 2000 (GB) ..... 0012442

(51) Int. Cl.[7] ..... B41J 2/01
(52) U.S. Cl. ..... 347/107; 347/104; 347/105
(58) Field of Search ..... 347/104, 107, 347/171, 215, 105; 271/109; 355/22

(56) References Cited

U.S. PATENT DOCUMENTS

| | | | | |
|---|---|---|---|---|
| 5,029,842 | A | 7/1991 | Belanger et al. | 271/188 |
| 5,057,180 | A | 10/1991 | Mattiebe | 156/352 |
| 5,431,321 | A | 7/1995 | Link et al. | 226/194 |
| 5,447,262 | A | 9/1995 | Focke et al. | 226/87 |
| 5,560,799 | A | 10/1996 | Jacobsen | 156/277 |
| 5,764,266 | A | 6/1998 | Azuma et al. | 347/171 |
| 5,835,194 | A | 11/1998 | Morton | 355/22 |
| 6,133,928 | A | 10/2000 | Kayashima et al. | 347/171 |

FOREIGN PATENT DOCUMENTS

| | | | |
|---|---|---|---|
| GB | 598148 | 2/1948 | |
| WO | WO 93/23244 | 11/1993 | B32B/3/28 |

*Primary Examiner*—John Barlow
*Assistant Examiner*—An H. Do
(74) *Attorney, Agent, or Firm*—Wilmer, Cutler & Pickering

(57) ABSTRACT

Printing onto lenticular material using an elongate feed cylinder having a feeding surface with a plurality of transversely arranged grooves that are substantially perpendicular to a central longitudinal axis of rotation of the elongate feed cylinder.

15 Claims, 5 Drawing Sheets

PRINTING ON LENTICULAR MEDIA

The invention relates to an apparatus and method for printing onto lenticular media.

FIG. 1 shows a typical lenticular material 10. Such lenticular print material, as shown by the detail view in FIG. 1 has a series of parallel ridges 11 which act as cylindrical lenses formed on a front surface 12 of the material 10.

The material 10 is transparent and has a substantially planar rear surface 13. The parallel ridges 11 run the full length of the material 10 and are closely and evenly spaced from one another, and give rise to a special optical effect as will be further explained below.

Referring now to FIG. 2, there is shown in schematic form a set of three neighbouring ridges or lenses $\mathbf{11}_1$, $\mathbf{11}_2$, $\mathbf{11}_3$. Beneath each of the lenses $\mathbf{11}_1$ –$\mathbf{11}_3$, there are laid strips forming parts of multiple images. In this instance, it is assumed that three images in total are viewable through the lenticular material. Parts $A_1$, $A_2$, $A_3$ forming part of a first image A, parts $B_1$, $B_2$, $B_3$ making up parts of a third image B and parts $C_1$, $C_2$, $C_3$ making up parts of a third image C. Each of the parts of any given image A, B, C are equally spaced from one another and situated beneath corresponding portions of the lenses $\mathbf{11}_1$ –$\mathbf{11}_3$. Because of the effect of the lenses, an observer looking at the lenticular material will effectively see a different image A, B or C dependent upon the viewing angle. In other words, by tilting the lenticular material, the viewer will see image A, B or C. These effects are very well known and such images tend to have a mostly recreational type value—for instance, printing a composite image based on a sequence of time displaced images of a scene onto lenticular material in the abovedescribed fashion is often used to provide novelty items for children in which when the material is tilted, the illusion of movement is conveyed to the observer.

As will be understood from the above, in order to provide consistent effects, there are a number of prerequisites. These prerequisites are that each image be divided accurately into consistently sized strips. Those strips should have a width which enables an integer number of such strips to be placed beneath each lens, that integer number corresponding to the number of images to be presented to the viewer. Each such strip must be precisely aligned in relation to the corresponding cylindrical lens formed by the ridges 11 of the lenticular material.

One method for providing such an image is to simply print the composite image formed by the offset strips of the divided images directly onto paper and then to manually align the printed composite image with a lenticular substrate and glue the printed image to the substrate. This has the obvious disadvantage that manual alignment is subject to human error.

It is an aim of embodiments of the present invention to provide a simplified method and apparatus for printing onto lenticular material with automatic alignment.

According to a first aspect of the invention, there is provided a printer including a feed tray upon which material to be printed upon is placed, an elongate feed cylinder having a paper feeding surface for advancing material from the feed tray along an input path, printing means for printing upon the material and an output path for delivering printed material from the printing means, the feed cylinder having a paper feeding surface of the feed cylinder including a plurality of evenly spaced apart transversely arranged grooves, said grooves each being substantially perpendicular to a central longitudinal axis of rotation of said feed cylinder.

The output path may be the input path.

Preferably, said grooves each have an internal form arranged to match the form of individual lenses of lenticular material with which the feed cylinder is to be used. Lenticular material generally is formed of cylindrical lenses in which case the grooves preferably each have a substantially constant internal radius of curvature.

Preferably, the substantially constant internal radius of curvature of said grooves corresponds to a radius of curvature of corresponding cylindrical lenses of lenticular material which it is desired to use in conjunction with said printer.

Preferably, said evenly spaced apart transversely arranged grooves are spaced apart from one another in accordance with a given lenses per inch (lpi) designation of lenticular material to be used in conjunction with said printer.

Preferably, at boundary regions between adjacent transverse grooves, said grooves are separated from each other by regions of the feed cylinder which are of a substantially constant transverse circular cross-sectional diameter.

According to a second aspect of the invention, there is provided a method of printing directly onto lenticular material, the method comprising feeding lenticular material into a printer, the printer including a feed tray upon which material to be printed upon is placed, an elongate feed cylinder having a paper feeding surface for advancing material from the feed tray along an input path, printing means for printing upon the material, and an output path for delivering printed material from the printing means, the feed cylinder having a feeding surface including a plurality of evenly spaced apart transversely arranged grooves, said grooves each being substantially perpendicular to a central longitudinal axis of rotation of said feed cylinder, the method comprising:

(i) inputting lenticular material into the feed tray of the printer, said lenticular material being oriented such that lenses formed on a front side of the lenticular material are arranged to be channelled into the grooves formed in the feeding surface of the feed cylinder to align the material as the feed cylinder is rotated and to feed the material along the input path to the printing means;

(ii) using the printing means, printing a composite image onto a reverse side of the lenticular material using a composite image signal; and (iii) delivering printed material from the printing means along the output path.

Preferably, there is performed the further step (iv) of applying a backing material to the reverse side of the lenticular material.

Preferably, said backing material comprises self-adhesive paper.

According to a third aspect of the invention, there is provided an elongate feed cylinder for a printer, a feeding surface of the feed cylinder being adapted for frictional engagement with a printing material and including a plurality of evenly spaced apart transversely arranged grooves, said grooves each being substantially perpendicular to a central longitudinal axis of rotation of said feed cylinder.

Preferably, said grooves each have an internal form arranged to match the form of individual lenses of lenticular material with which the feed cylinder is to be used. Lenticular material generally is formed of cylindrical lenses in which case the grooves preferably each have a substantially constant internal radius of curvature.

Preferably, said substantially constant internal radius of curvature of said grooves corresponds to a radius of curvature of corresponding cylindrical lenses on lenticular material which it is desired to use in conjunction with said feed cylinder.

Preferably, said evenly spaced apart transversely arranged grooves are spaced apart from one another in accordance with a given lenses per inch (lpi) designation of lenticular material to be used in conjunction with said feed cylinder.

Preferably, at transverse boundary regions between adjacent transverse grooves, said grooves are separated from each other by regions of the feed cylinder which are of a substantially constant transverse cross-sectional diameter.

Preferably, each of said boundary regions is of identical dimensions and each boundary region each occupies a given transverse area of the cylinder and is of a constant circular cross-sectional diameter.

For a better understanding of the invention, and to show how embodiments of the same may be carried into effect, reference will now be made, by way of example, to the accompanying diagrammatic drawings in which.

The lenticular material comprises a plastics material which is provided (by means of molding or extrusion for instance) with, as mentioned previously, a series of closely and evenly spaced parallel cylindrical lenses, these lenses providing a uniform set of ridges on a front surface 12 of the material 10. Lenticular material is specified as having a particular pitch between lenses and such a pitch is usually denoted as being a certain number of lenses per inch (lpi). In the discussion below, and by way of example only, lenticular material having 75 lpi will be discussed. With lenticular material of 75 lpi if eight discrete images are to be presented according to viewing angle, then each lens or ridge 11 must cover eight colinear and adjacent strips, one for each of the eight images, aligned beneath it. Therefore, for each inch width-wise of the lenticular material, there will be 8×75=600 individual strips (i.e. slices) of the various images required to be aligned and printed. The minimum printing resolution of the printer for doing this must therefore be 600 dpi. Naturally, the higher the resolution of the printer, the more dots are allocated per strip and the more convincing the printed item will be. These days, it is not uncommon for individual users to possess colour ink jet printers having resolutions of perhaps up to 2400 dpi and, of course, as technology progresses higher resolution printers become available for lower prices.

The major problem from a home user point of view in providing printing onto lenticular substrates is not printer resolution, but rather that the alignment mechanisms for home printers are simply not accurate enough to deal with direct printing on lenticular material 10. This is because the alignment of individual sheets of material depends on how a user feeds that material into the printer, if it is fed into the printer at a slight skew, then the printed result will also be skewed.

Figure 1:
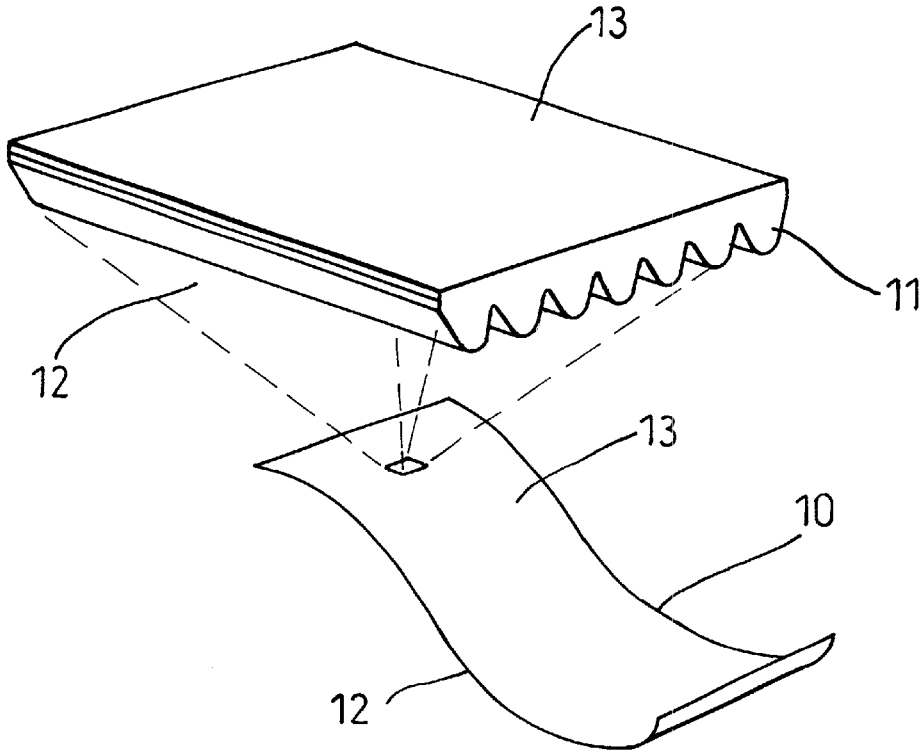
FIG. 1 shows a typical lenticular substrate.
Figure 2:
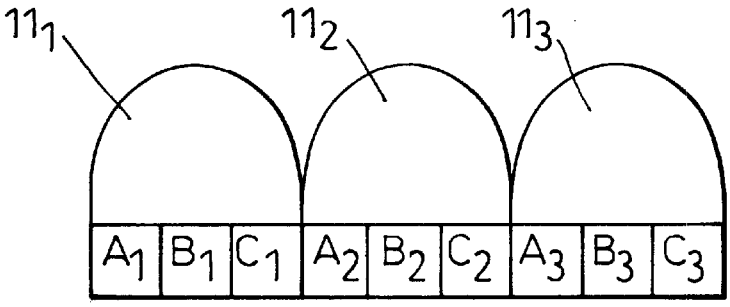
FIG. 2 illustrates alignment of individual image strips beneath lenses of a lenticular substrate.
Figure 3:
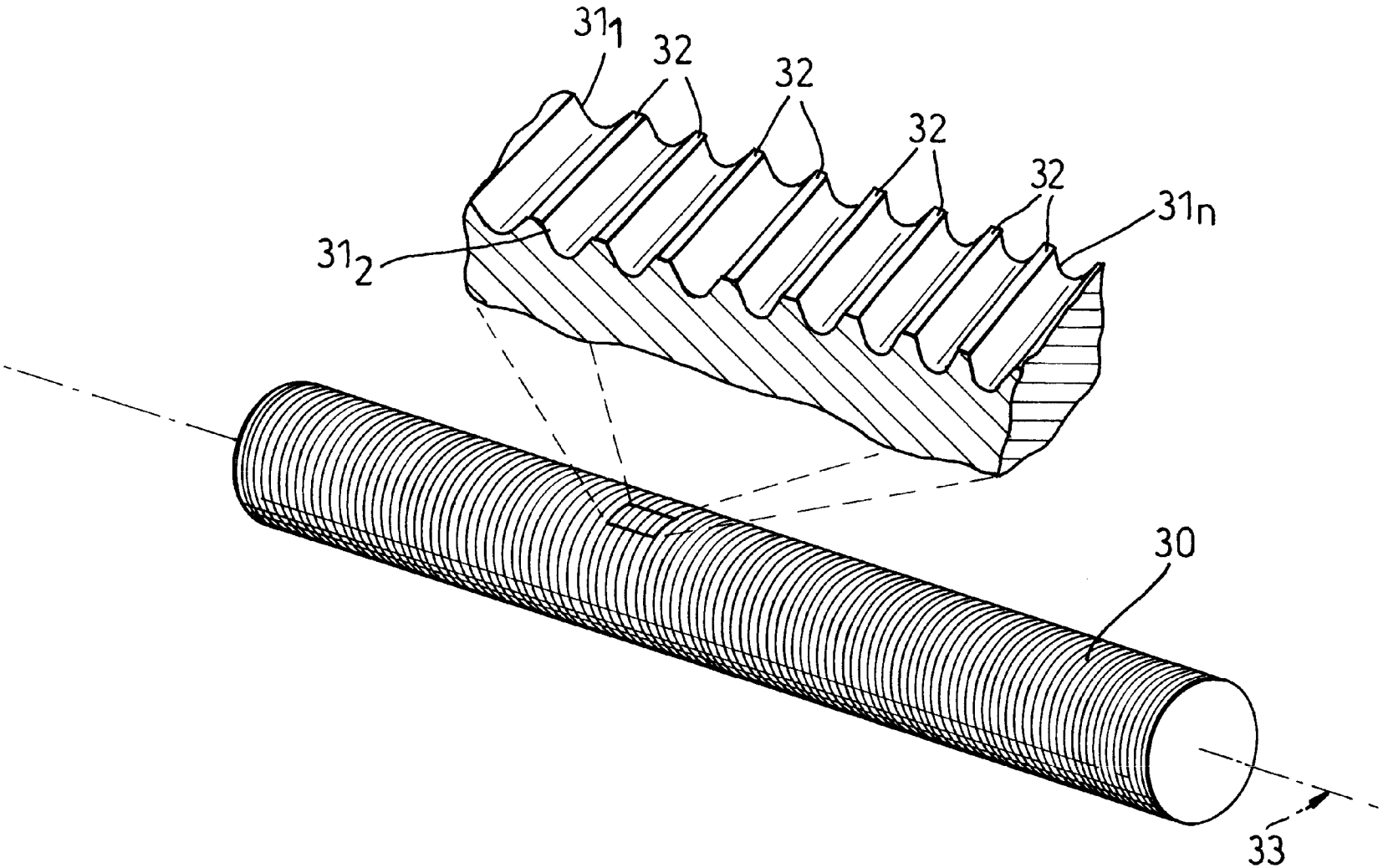
FIG. 3 shows a feeding cylinder of a printer which is adapted to provide automatic alignment of lenticular material.

Referring now to FIG. 3, there is shown a specially adapted feeding cylinder for use in a lenticular-enabled printer. The printer is in all respects apart from the feed cylinder 30, a conventional one. The feed cylinder 30 "grips" paper or the appropriate printing material (ie it operates by frictional engagement) in a conventional manner—however, the feed cylinder 30 is provided with parallel grooves 31, the radius of curvature of the grooves is closely matched to the radius of curvature of the cylindrical lenses or ridges of a particular predetermined pitch lenticular material. For instance in the above discussion, the bottom of groove trough $\mathbf{31}_1$ is arranged to be separated from its neighbour $\mathbf{31}_2$ in a transverse direction by 1/75 of an inch and so on so as to make the feed cylinder 30 correspond to lenticular material 10 of 75 lpi designation. The grooves $\mathbf{31}_1$–$\mathbf{31}_n$, rather than meeting their adjacent grooves at adjacent side walls in a peak, are separated from one another by flat ridges 32. Providing such flat ridges 32 ensures that when a printer incorporating such a feed cylinder 30 is used for feeding normal paper a sufficient proportion of the cylinder 30 contacts with that paper so as to provide enough grip for feeding ordinary paper through the printer. The grooves $\mathbf{31}_1$–$\mathbf{31}_n$, meanwhile provide a self-alignment mechanism with lenticular material 10 fed into the printer so that if there is a slight skew to that material when entering it into a feed portion of the printer, the feed cylinder 30 rotating about central longitudinal axis 33 will mechanically resolve that misalignment automatically. Therefore, the feed cylinder 30 provides a means by which a consistent and precise alignment of lenticular material 10 passing through the printer may be achieved, the lenses $\mathbf{11}_1$ to $\mathbf{11}_n$ being automatically aligned within grooves $\mathbf{31}_1$ to $\mathbf{31}_n$.

Figure 4:
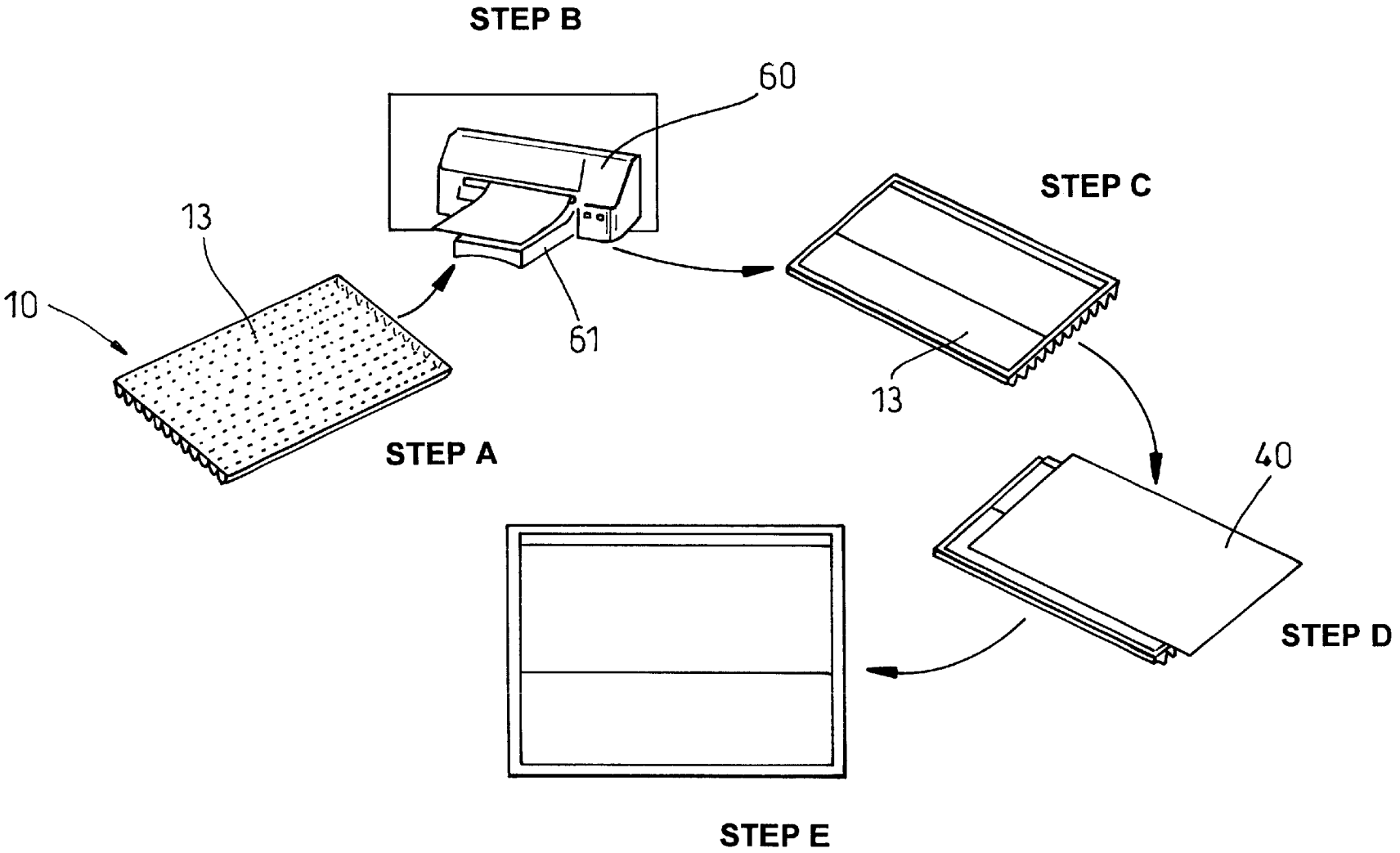
FIG. 4 illustrates the steps involved from a user point of view in obtaining a lenticular image.

Referring now to FIG. 4, there is shown in schematic form the means by which a user may feed lenticular material into a lenticular enabled printer so as to obtain a completed lenticular image.

Referring now to FIG. 4, in a first step A lenticular material 10 is entered into the feed tray 61 of a printer 60 which includes a feed cylinder 30 of the type shown in FIG. 3 (a preferred embodiment of such a printer will be described in more detail in FIG. 6 later). The reverse side 13 of lenticular material 10 is printed on by the printer 60 in step B using a composite image signal (in reality eight images divided into image strips as mentioned previously), transmitted to the printer 60 by, for instance, the printer port of a personal computer. In fact, the composite image is a mirror image of the desired finished composite image since, to view the image, that image will be observed by looking through the front side 12 of the lenticular material 10. The result of the printing step B is therefore an image, shown in step C, printed onto the reverse side 13 of the transparent lenticular material 10. In order to view the image properly, it is then necessary in step D to provide adhesive backing paper 40 which is to be stuck onto the reverse side 13 of the lenticular material 10 to provide a background against which the finished lenticular image in step E may be viewed. The adhesive backing paper 40 applied in step D is preferably self-adhesive and, as well as providing the necessary background to the finished image also protects that image from being damaged through minor abrasions etc.

Figure 5:
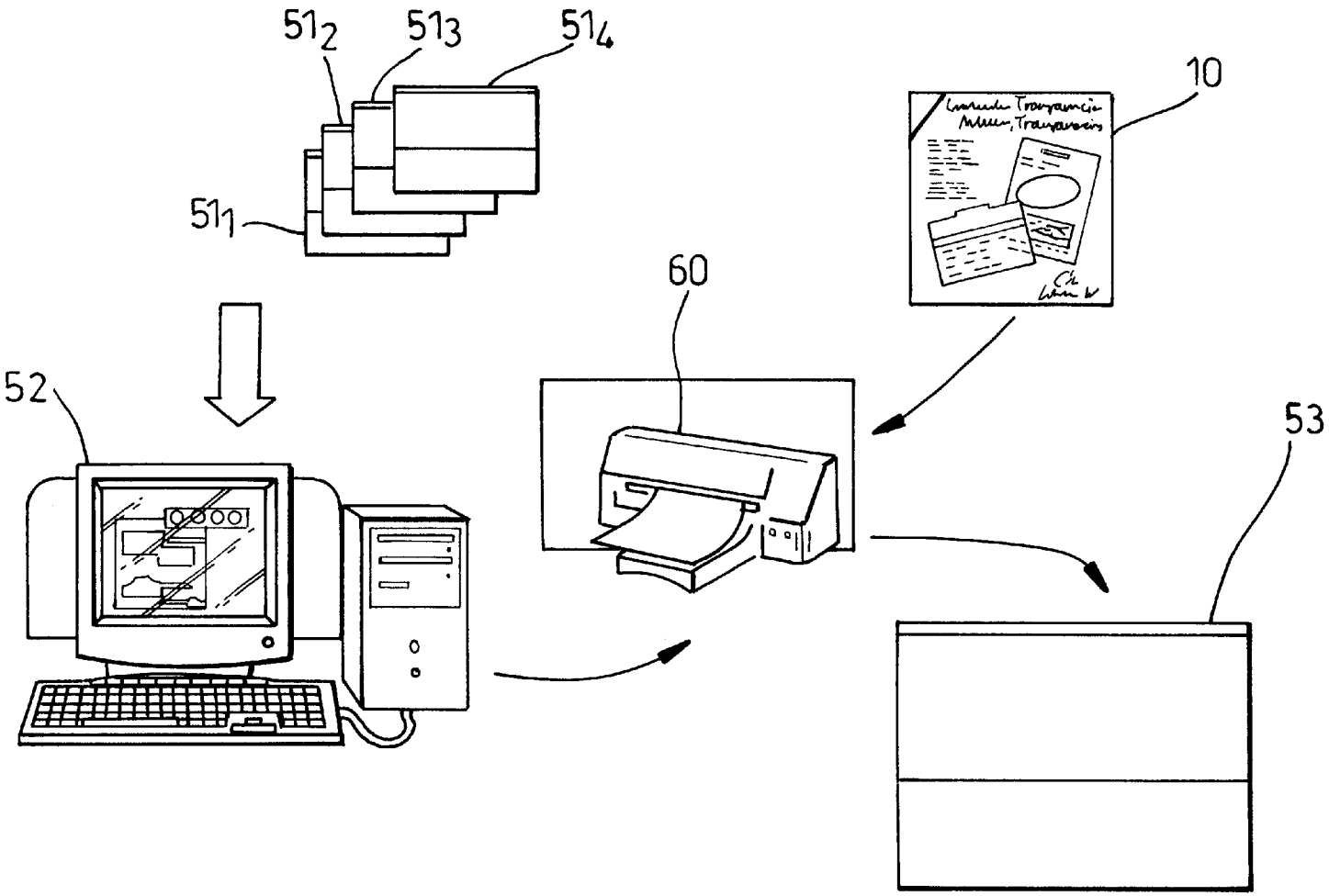
FIG. 5 illustrates how, in practice, a user may produce lenticular images from a personal computer using a lenticular-enabled printer.

Considering now FIG. 5, there is shown in schematic form how a user may take multiple shot content 51 representing various images $\mathbf{51}_1$–$\mathbf{51}_4$ entered into a personal computer 52 (for instance from disc, by scanning or from the internet) and, with appropriate software loaded on the computer 52, combine that multiple shot content 51 into a single composite mirror image comprising the required strips of the multishot content alternating with one another in a consistent fashion, provide an appropriately formatted output to a lenticular enabled printer 60 and feed that printer 60 with lenticular media 10 to provide a finished lenticular image 53 which changes its appearance according to viewing angle so as to successively view images $\mathbf{51}_1$ to $\mathbf{51}_4$ as the image 53 is tilted from side to side.

Although not discussed in any detail, it will be appreciated that before outputting the print signals to the lenticular enabled printer 60, appropriate software within the personal computer is arranged to provide the composite lenticular images, such software is not however part of this invention.

Figure 6:
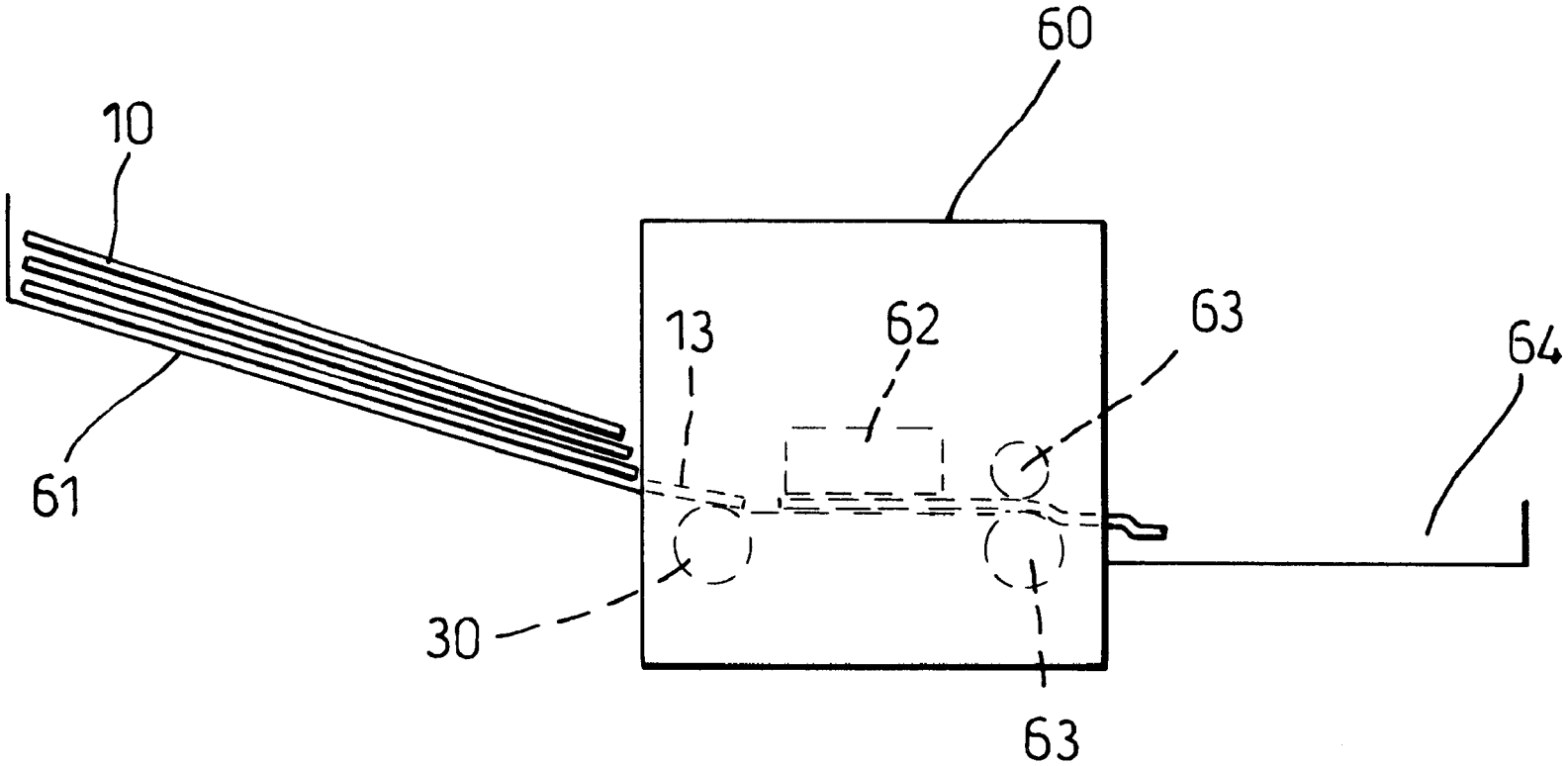
FIG. 6 shows an exemplary embodiment of a printer enabled for printing on lenticular material utilising the feed cylinder of FIG. 3.

Referring now to FIG. 6, there is shown in schematic form a lenticular material enabled printer in accordance with embodiments of the present invention.

The printer of FIG. 6 comprises an input feed tray 61 in which material, including paper or lenticular material may be deposited, the feed tray 61 forming the first part of an input path, the elongate feed cylinder 30 as described in relation to FIG. 3, printing means 62 (which may, for instance, comprise any ink jet printer head on an appropriate carriage), and output rollers 64 and an output tray 65 constituting an output path.

In use, the printer of FIG. 6 operates as follows. It is presumed at this stage that the feed tray 61 is loaded with lenticular material.

A first sheet of lenticular material in the feed tray 61 comes into contact with the feed cylinder 30. As the feed cylinder 30 rotates, ridges 11 of the lenticular material 10 automatically slot into the matching grooves 31 of the feed cylinder 30 and, under frictional contact therewith, rotation of the feed cylinder 30 aligns and feeds the lenticular material 10 to the printing means 62. The printing means 62 then, fed with an appropriate composite image signal, prints onto the reverse side 13 of the lenticular material 10 to form an image thereon. As printing is completed, output rollers 63 feed the printed material to the output tray 64. Once in the output tray a user can then pick up the printed material and provide the required backing to it.

It will be appreciated that whilst in the printer shown, there is defined an output path by means of the output roller 63 feeding to the output tray 64, in alternative arrangements (with a single sheet feeder) the output path may comprise the input path such that printed material may be passed back out so as to reappear in the input tray for collection. In such arrangements, the feed cylinder 30 may be arranged to rotate in a first direction for feeding, and in a second direction for outputting.

It will be evident to the man skilled in the art that various modifications may be carried out within the scope of the invention and that the scope of the invention is limited only by the attached claims.

What is claimed is:

1. A printer including a feed tray upon which material to be printed upon is placed, an elongate feed cylinder having a paper feeding surface for advancing material from the feed tray along an input path, a printer head for printing upon the material and an output path for delivering printed material from the printer head, including a plurality of evenly spaced apart transversely arranged grooves, said grooves each being substantially perpendicular to a central longitudinal axis of rotation of said feed cylinder.

2. A printer according to claim 1, wherein said grooves each have a substantially constant internal radius of curvature.

3. A printer according to claim 2, wherein said substantially constant internal radius of curvature of said grooves corresponds to a radius of curvature of corresponding cylindrical lenses of lenticular material which it is desired to use in conjunction with said printer.

4. A printer according to claim 1, wherein said evenly spaced apart transversely arranged grooves are spaced apart from one another in accordance with a given lenses per inch designation of lenticular material to be used in conjunction with said printer.

5. A printer according to claim 1, wherein at boundary regions between adjacent transverse grooves, said grooves are separated from each other by regions of the feed cylinder which are of a substantially constant transverse circular cross-sectional diameter.

6. A printer according to claim 1, wherein the feed cylinder is used for frictional engagement with printing material.

7. A method of printing directly onto lenticular material, the method comprising feeding lenticular material into a printer, the printer including a feed tray upon which material to be printed upon is placed, an elongate feed cylinder having a paper feeding surface for advancing material from the feed tray along an input path, a printer head for printing upon the material, and an output path for delivering printed material from the printing means, said paper feeding surface including a plurality of evenly spaced apart transversely arranged grooves, said grooves each being substantially perpendicular to a central longitudinal axis of rotation of said feed cylinder, the method comprising:

(i) inputting lenticular material into the feed tray of the printer, said lenticular material being oriented such that lenses formed on a front side of the lenticular material are arranged to be channelled into the grooves formed in the feeding surface of the feed cylinder to align the material as the feed cylinder is rotated and to feed the material along the input path to the printer head;

(ii) using the printer head, printing a composite image onto a reverse side of the lenticular material using a composite image signal; and (iii) delivering printed material from the printer head along the output path.

8. A method according to claim 7, wherein there is performed the further step (iv) of applying a backing material to the reverse side of the lenticular material.

9. A method according to claim 8, wherein said backing material comprises self-adhesive paper.

10. A feed cylinder for a printer, said feed cylinder comprising a paper feeding surface used for frictional engagement with printing material, said paper feeding surface including a plurality of evenly spaced apart transversely arranged grooves, said grooves each being substantially perpendicular to a central longitudinal axis of rotation of said feed cylinder.

11. A feed cylinder according to claim 10, wherein said grooves each have a substantially constant internal radius of curvature.

12. A feed cylinder according to claim 11, wherein said substantially constant internal radius of curvature of said grooves corresponds to a radius of curvature of corresponding cylindrical lenses on lenticular material which it is desired to use in conjunction with said feed cylinder.

13. A feed cylinder for a printer according to claim 10, wherein said evenly spaced apart transversely arranged grooves are spaced apart from one another in accordance with a given lenses per inch designation of lenticular material to be used in conjunction with said feed cylinder.

14. A feed cylinder according to claim 10, wherein at transverse boundary regions between adjacent transverse grooves, said grooves are separated from each other by regions of the feed cylinder which are of a substantially constant transverse cross-sectional diameter.

15. A feed cylinder according to claim 14, wherein each of said boundary regions is of identical dimensions and each boundary region occupies a given transverse area of the cylinder and is of a constant circular cross-sectional diameter.

* * * * *